US007168584B2

(12) United States Patent
Akopyan

(10) Patent No.: US 7,168,584 B2
(45) Date of Patent: Jan. 30, 2007

(54) COMBINED MULTI-GOBLET

(76) Inventor: Arshak Akopyan, 1215 E. Colorado St., Suite 202 B, Glendale, CA (US) 91205

( * ) Notice: Subject to any disclaimer, the term of this patent is extended or adjusted under 35 U.S.C. 154(b) by 293 days.

(21) Appl. No.: 10/862,158

(22) Filed: Jun. 7, 2004

(65) Prior Publication Data

US 2005/0269323 A1 Dec. 8, 2005

(51) Int. Cl.
*B65D 19/00* (2006.01)
*B65D 21/02* (2006.01)
*B65D 1/04* (2006.01)

(52) U.S. Cl. ..... 220/23.83; 220/23.4; 215/6

(58) Field of Classification Search ..... 220/23.83, 220/23.4, 23.86; 215/6
See application file for complete search history.

(56) References Cited

U.S. PATENT DOCUMENTS 2,731,013 A * 1/1956 Holmes ..... 604/416
3,052,368 A * 9/1962 Atkins et al. ..... 215/6
D299,624 S * 1/1989 Rothman et al. ..... D11/152
D336,594 S * 6/1993 Trush ..... D7/537
D380,122 S * 6/1997 Wong ..... D7/513
D395,379 S * 6/1998 Goodman ..... D7/513
6,123,214 A * 9/2000 Goebel ..... 220/23.4
6,325,229 B1 * 12/2001 Anders ..... 220/23.4
6,820,767 B2 * 11/2004 Nicholas ..... 222/144.5
D515,870 S * 2/2006 Akopyan ..... D7/513
D518,997 S * 4/2006 Salkow et al. ..... D7/513

* cited by examiner

*Primary Examiner*—Jes F. Pascua
*Assistant Examiner*—Shawn M Braden

(57) ABSTRACT

The combined multi goblet represents a set of several separate goblets that can be used for different beverages. The bottom configuration of part-goblets let them stay stably either separately or as a combined set. The combination of part-goblets is formed by setting the bases one on another as layers, as shown on FIG. 2.

1 Claim, 2 Drawing Sheets

COMBINED MULTI-GOBLET

CROSS-REFERENCE TO RELATED APPLICATIONS

U.S. PATENT DOCUMENTS

| | | | |
|---|---|---|---|
| 97,583 | December 1869 | Adler et al | |
| 1,164,050 | December 1915 | Zodak | |
| 1,736,264 | November 1929 | Johnson | |
| 2,335,016 | November 1943 | Lorenzen et al | 206/42 |
| 2,731,013 | January 1956 | Holmes | 128/272 |
| 2,747,387 | May 1956 | Sweem | 65/13 |
| 3,684,123 | August 1972 | Bridges | 220/9 R |
| 4,703,849 | November 1987 | Vezirian et al | 206/217 |
| 4,955,503 | September 1990 | Propes | 220/526 |

BACKGROUND OF THE INVENTION

This invention relates generally to improvements in drinking goblets.

In particular, a major object of the invention is directed to provide a novel drinking glass for restaurants, bars, cafes, to serve several beverages in one actual goblet. The invention simplifies the serving process by saving time, room on the serving tray, and room on the table. For instance, in restaurants, instead of bringing and serving several glasses for each person at a table, it is more expedient to use one combined multi-goblet. Use of the combined multi-goblet also allows servers to serve more tables before returning to the bar or kitchen. The set combines very easy and fast, and does not require much balance during carrying because of a plastic clip, that attaches to a stem.

Another object of the present invention is to provide several drinking glasses that are formed to give the appearance of one whole goblet.

BRIEF SUMMARY OF THE INVENTION

The above objectives are accomplished according to the present invention by providing a set of several drinking goblets. The invented set is easily combined and exploded. It also keeps stability while carrying because of a plastic clip. The design makes the serving process of two to four different beverages easy and fast.

DETAILED DESCRIPTION

Figure 1:
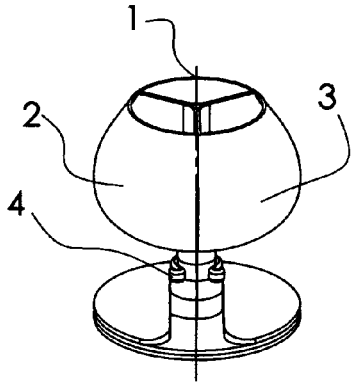
FIG. 1 is a perspective view of a multi-goblet.
Figure 3:
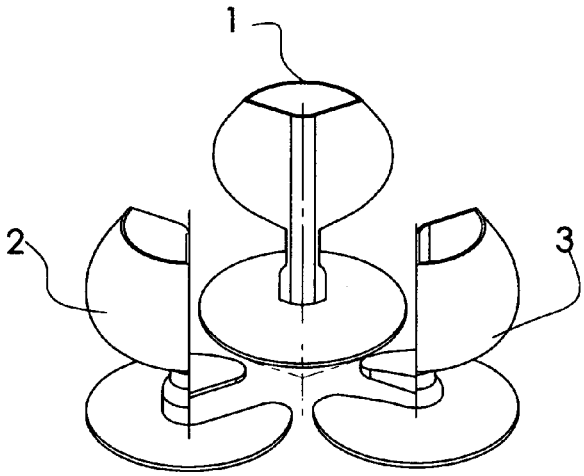
FIG. 3 is an exploded perspective view, that shows stability of each part-goblet itself.
Figure 4:
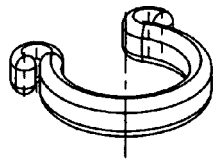
FIG. 4 is a clip that attaches to a stem for carrying.
Figure 7:
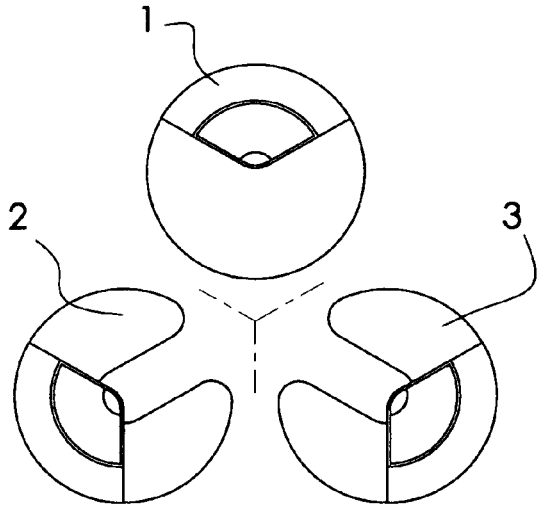
FIG. 7 is an exploded top plan view.

The combined multi-goblet represents a set of several individual goblets that, as a set, has the appearance of one whole goblet. FIG. 1 shows the combination of three goblets, where 1 is main part-goblet, 2 and 3 are identical auxiliary part-goblets, and 4 is a holding clip. FIG. 4 shows a holding clip separately. FIG. 3 shows an exploded view for the multi-goblet. The part-goblets' center of gravity is calculated in a way that maintains stability either separately or as a combined set. For making a set more stable during carrying, a plastic clip is used that very easily attaches to and detaches from the stem of combined set. As it can be seen on the FIG. 7, the top of each part-goblet has the form of a sector of a circle with the center on the central axis of symmetry.

Figure 5:
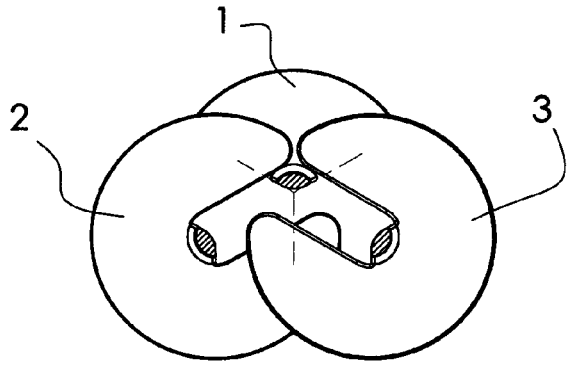
FIG. 5 is a sectional top plan of the bottom of combining set.

The essential novelty element of the invention is the form of the bottom with the congruent cuts that keep the part-goblets stable either separately or as a whole set. A sectional top plan of the bottoms of the combining set is shown on the FIG. 5.

Figure 2:
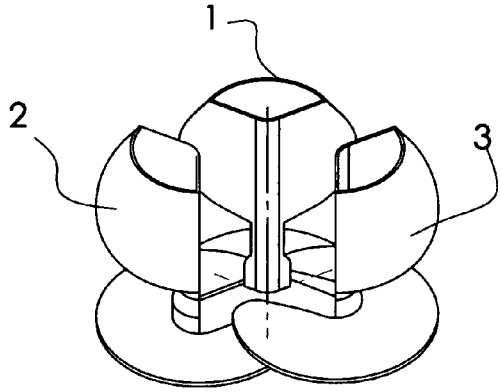
FIG. 2 is a combining perspective view.
Figure 6:
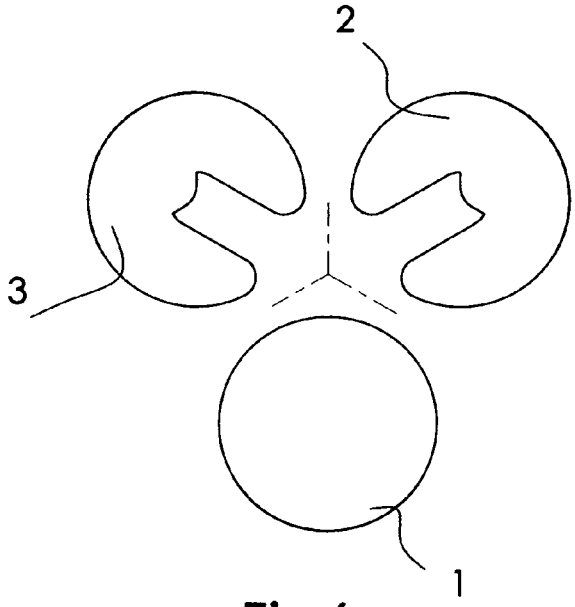
FIG. 6 is an exploded bottom plan view.

The part-goblet 1's bottom represents the main base for the set. The bottoms of auxiliary part-goblets are the same. Each of them has a cut which is the width of the stem, and has the length of the radius of the bottom base circle, as shown on FIG. 6. The inner part of the cut around the stem is made so that the auxiliary part-goblets combine around the main part-goblet 1, as shown on FIG. 2 and FIG. 5. This configuration lets combine all part-goblets and clip them very easily, which maintains stability.

What I claim as my invention is:

1. A set of interlocking goblets comprising:

three sequentially combining goblets, a base goblet, a middle goblet, and a top goblet, where each goblet's bowl has one/third-circle cross section;

three sequentially combining goblets where each goblet has a stem representing a one/third section of a cylinder, where the stem of the base goblet is longer than the stem of the middle goblet on the length equal to the width of the middle goblet's bottom, and the stem of the middle goblet is longer than the stem of the top goblet on the length equal to the width of the top goblet's bottom;

three sequentially combining goblets whose bottoms have a form of a circle with equal diameters with the middle and the top goblets' bottoms having identical slots with curving edges at the outer circles where the length of said slot is equal to the radius of the goblet's bottom, and the width of said slot is equal to the double radius of said stems;

three sequentially combining goblets equipped with a separate a clip made from plastic or any partially flexible material in a form of a open-ends circle.

* * * * *